United States Patent [19]

De Fraeye

[11] B 3,986,067

[45] Oct. 12, 1976

[54] ELECTRIC INCANDESCENT LAMP WITH SUPPORT STRUCTURE FOR A PLANAR FILAMENT

[75] Inventor: Dirk Jules Remi De Fraeye, Eindhoven, Netherlands

[73] Assignee: U.S. Philips Corporation, New York, N.Y.

[22] Filed: Dec. 12, 1974

[21] Appl. No.: 531,929

[44] Published under the second Trial Voluntary Protest Program on January 20, 1976 as document No. B 531,929.

[30] Foreign Application Priority Data

Jan. 21, 1974 Netherlands ..... 7400763

[52] U.S. Cl. ..... 313/273; 313/222; 313/274; 313/277; 313/315

[51] Int. Cl.[2] ..... H01K 1/24

[58] Field of Search ..... 313/222, 273, 274, 277, 313/315, 316

[56] References Cited

UNITED STATES PATENTS

| | | | |
|---|---|---|---|
| 480,954 | 8/1892 | Melick | 313/316 |
| 2,006,820 | 7/1935 | Adams et al. | 313/274 |
| 2,791,713 | 5/1957 | Dean | 313/277 |
| 3,497,753 | 2/1970 | Huston, Jr. | 313/222 |
| 3,555,338 | 1/1971 | Scoledge et al. | 313/315 |
| 3,626,236 | 12/1971 | Robinson et al. | 313/222 |
| 3,777,207 | 12/1974 | Noteteirs et al. | 313/222 |

*Primary Examiner*—Alfred E. Smith
*Assistant Examiner*—Wm. H. Punter
*Attorney, Agent, or Firm*—Frank R. Trifari

[57] ABSTRACT

An electric incandescent lamp and method of manufacturing same in which two filaments stretched in frames are arranged. The frames are coupled together by a brace having a central portion which is incorporated in the exhaust tube seal in the upper wall of the lamp envelope.

2 Claims, 3 Drawing Figures

ELECTRIC INCANDESCENT LAMP WITH SUPPORT STRUCTURE FOR A PLANAR FILAMENT

Figure 1:
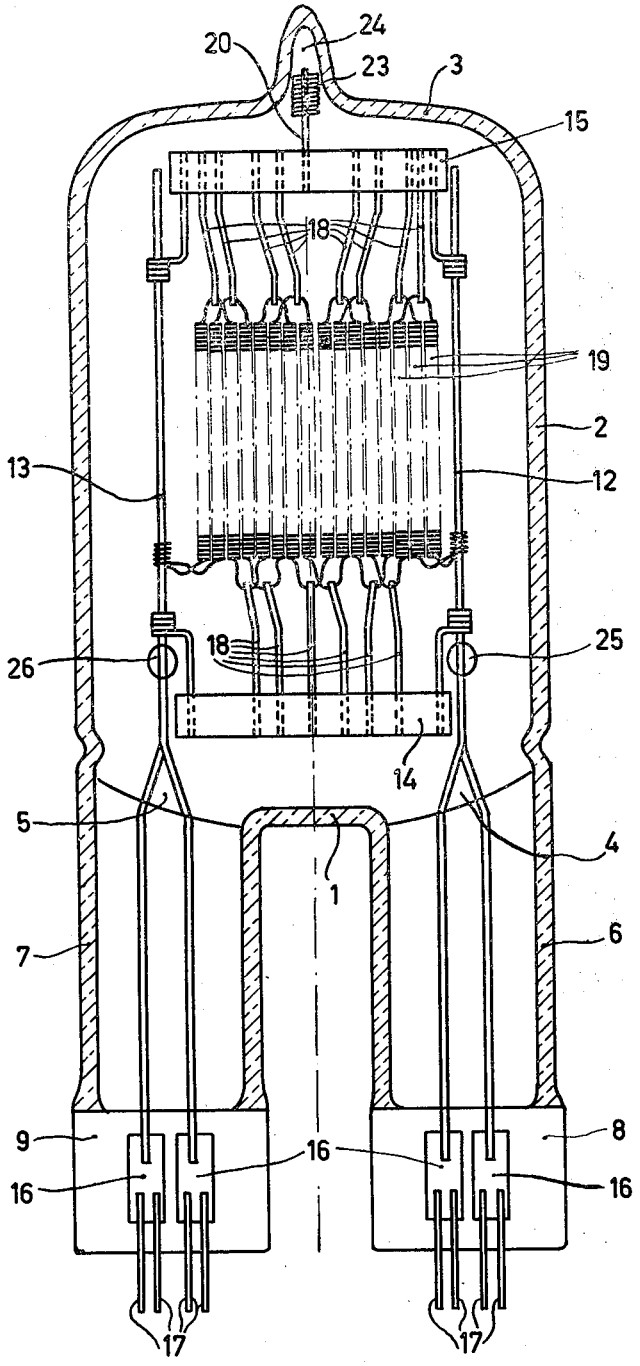

The invention relates to an electric incandescent lamp, in particular a halogen incandescent lamp, which comprises a glass lamp envelope having a disk-shaped bottom portion in which two oppositely arranged filaments are accommodated, each filament being stretched in a frame which is formed by two side beams and two cross beams, said side beams being connected to current supply members sealed in the bottom portion, holding means being present which fix the frames relative to the upper wall of the lamp envelope present opposite to the bottom portion. Such an incandescent lamp is known inter alia from the Dutch Published Patent Application No. 7,004,231.

In the known incandescent lamp of this type which is particularly suitable for studio illumination, the end portions of the side beams of the frames remote from the bottom portion are each secured in a tube sealed to the upper wall of the lamp envelope. As a result of this, the frames with the filaments stretched therein in a zig-zag manner are held in the lamp envelope at the desired distance relative to each other and in the correct position. It has furthermore been proposed already to use four bulges in the glass material of the upper wall instead of four tubes, in which bulges the end portions of the side beams extend.

In manufacturing such known incandescent lamps, a dish-like bottom portion is used which has preferably been formed by a moulding operation and in which the current supply members are sealed. Said bottom portion furthermore has an aperture which communicates with an exhaust tube. The current supply members are either secured to the filaments already in a previous operation and form one assembly with the previously manufactured assembly of frames and filaments, or they are secured to the filaments after having been sealed in the bottom portion. When the frames with the filaments stretched therein are thus connected to the bottom portion, a part of the lamp envelope, which consists of a preferably cylindrical side wall and the upper wall having four tubes or bulges, is slid over the frames and sealed to the edge of the dish-like bottom portion.

It has been found that said sealing operation in manufacturing said lamps often causes rejects. Said rejects are the more disadvantageous because a substantially finished product, including frames and filaments, is lost.

It is the object of the invention to provide an electric incandescent lamp of the above-described kind in which provisions are made which enable said drawback to be avoided.

For that purpose, the electric incandescent lamp according to the invention is characterized in that the holding means are formed by a brace the end portions of which are each connected to one of the cross beams of the frames present on the side of the upper wall and a central portion of which present between said end portions is incorporated in a cavity present in the upper wall and preferably formed by sealing an exhaust tube.

The frames are mutually spaced by said brace so that a comparatively rigid assembly of frames and filaments is already obtained. The incorporation of the central portion of the brace in a cavity which preferably coincides with the longitudinal axis of the lamp envelope and which has been formed upon sealing an exhaust tube has the advantage that the presence of four tubes or bulges in the upper wall of the lamp envelope has become superfluous.

The measures proposed according to the invention make it possible that in the manufacture of said lamp a tubular lamp envelope may be used as the starting material which is still open at its upper end but which forms already one assembly with the dish-like bottom portion. Although, as in the known incandescent lamp, such a lamp envelope may be manufactured by sealing the bottom portion to a glass tube, said operation is carried out before the frames with the filaments are arranged in the lamp envelope. If defects occur during the sealing operation, this does not result in loss of the frames and the filaments.

Upon assembling the incandescent lamp according to the invention, a complete assembly of two frames with the filaments stretched therein and the brace which connects the frames together is inserted into the lamp envelope via the open side and is secured to the bottom portion, after which the part of the tubular lamp envelope remote from the bottom portion is softened by heating and, in order to form an exhaust tube, reduced in cross-sectional area by means of, for example, shaping rollers, but for a small aperture in which the central portion of the brace extends. The edge of the lamp envelope may also be closed but for a small aperture, after which an exhaust tube is sealed to the edge of said aperture. The lamp envelope may then be evacuated, rinsed and filled with a suitable filling gas. The exhaust tube is finally sealed.

A favourable embodiment of the electric incandescent lamp according to the invention is characterized in that the brace is formed by two pieces of wire of each of which one end portion is secured to a cross beam and the other end portions of which are coupled together. The advantage hereof is that during the manufacture of the individual frames a piece of wire may be sealed in the upper quartz glass cross beam of a frame. Upon coupling the frames, only the free ends of the wire places need be connected together. This may be carried out by means of a welding or soldering operation or by winding a supporting wire around the free ends of the pieces of wire so as to form the central portion of the brace.

Another favourable embodiment of the electric incandescent lamp according to the invention is characterized in that the frames comprise bridge-shaped members at the area of the cross beams facing the bottom portion, which members connect the frames together. The bridge-shaped members are preferably formed by beams consisting of quartz glass in which the oppositely located side beams of the frames are sealed. Said bridge-shaped members form an extra reinforcement of the assembly of the frames so that it is prevented that upon assembling deformation of said assembly occurs.

The invention furthermore relates to a method of manufacturing the electric incandescent lamp according to the invention in which the frames with the filaments stretched therein are first connected to the bottom portion after which the lamp envelope is sealed but for an aperture for an exhaust tube, and finally the lamp is finished, which method according to the invention is characterized in that the starting material is a tubular lamp envelope which forms one assembly with the bottom portion and which is open on its side remote from the bottom portion, via which open side the frames are inserted into the lamp envelope and are then fixed relative to the bottom portion, after which the open side is sealed in such manner that only an aperture for the exhaust tube remains, in which aperture the central portion of the brace extends.

Figure 2:
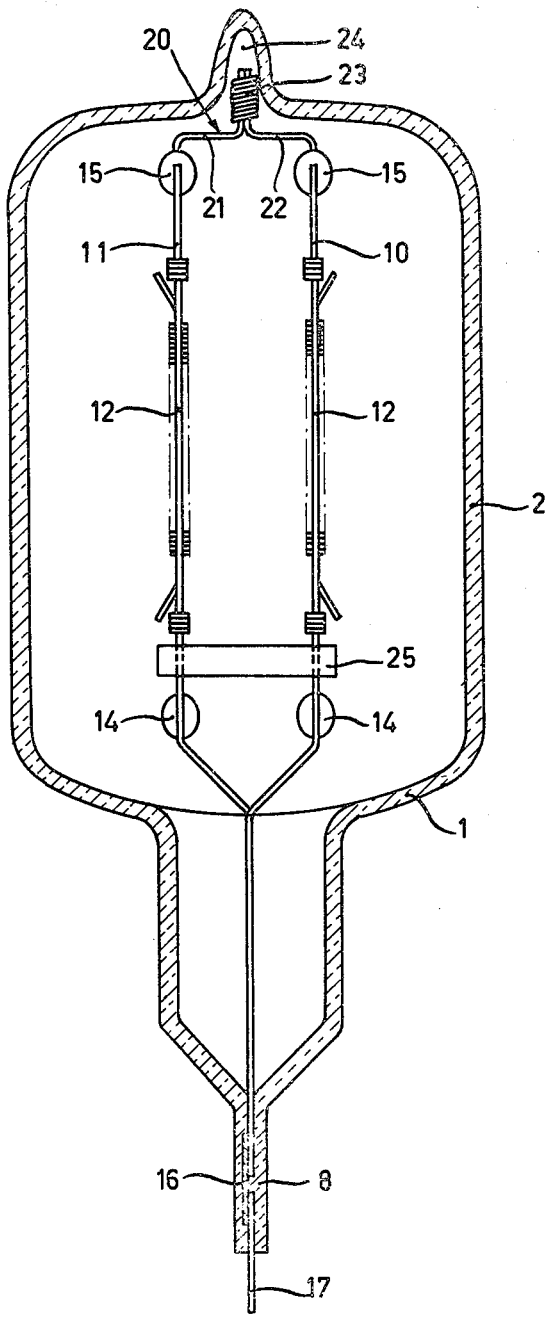
Figure 3:
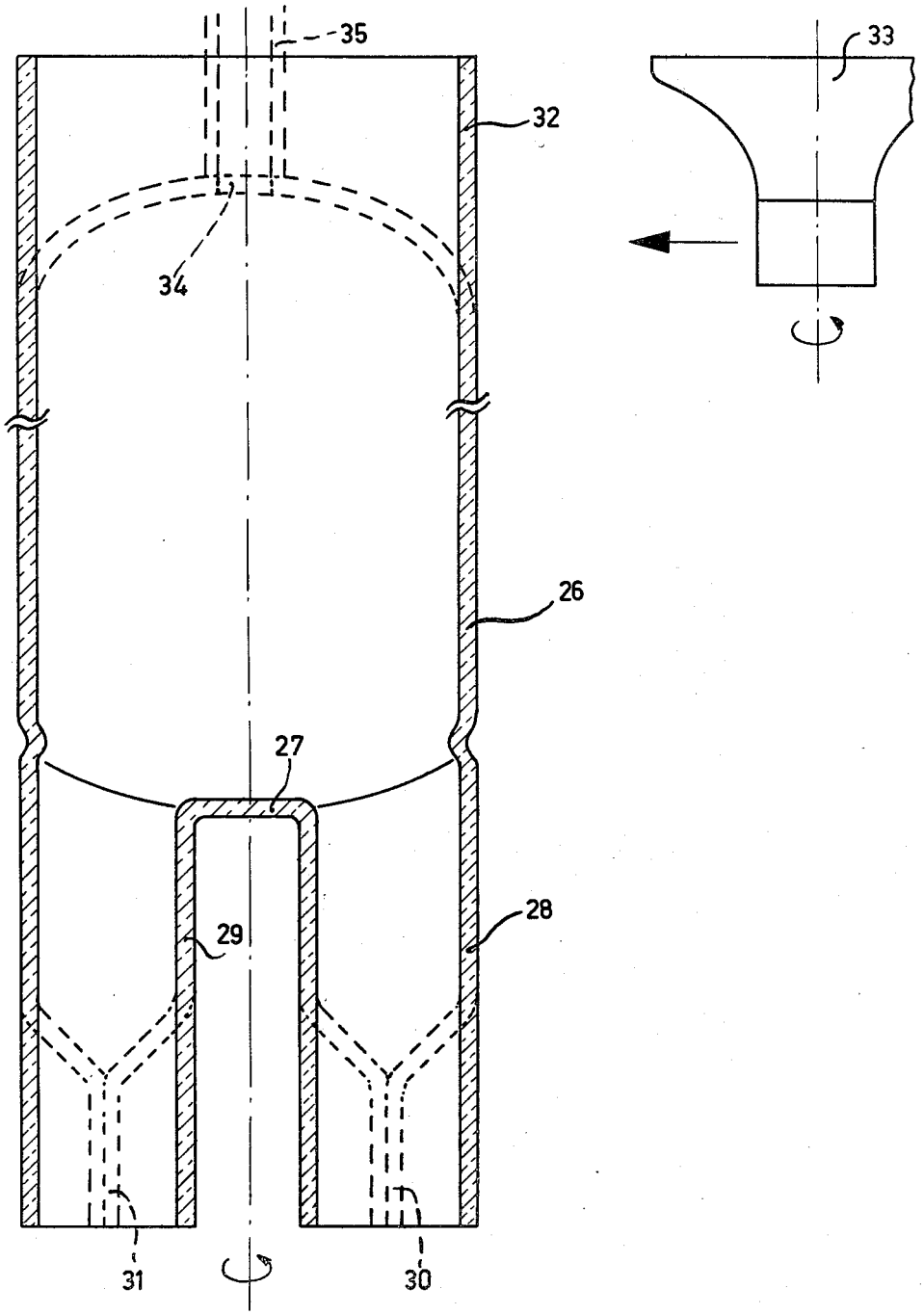

The invention will be described in greater detail with reference to a drawing, in which FIG. 1 is a front elevation of the electric incandescent lamp according to the invention, FIG. 2 is a side elevation of the incandescent lamp shown in FIG. 1, FIG. 3 shows a stage during the manufacture of the electric incandescent lamp according to the invention.

As is shown in FIG. 1, the electric incandescent lamp comprises a lamp envelope which consists of a dish-shaped bottom portion 1, a cylindrical side wall 2 and an upper wall 3. The bottom portion 1 comprises two apertures 4 and 5 to the edges of which quartz glass tubes 6 and 7, respectively, are sealed, which tubes are closed by seals 8 and 9, respectively. Two frames 10 and 11 are arranged in the lamp envelope (see FIG. 2) which are formed by side beams 12 and 13 and cross beams 14 and 15. The side beams 12 and 13 extend in the tubes 6 and 7, respectively, and are connected to current supply members each consisting of a molybdenum foil 16 sealed in the pinched seal and conductors 17 welded thereto and projecting beyond the lamp envelope. The cross beams 14 and 15 are formed from quartz glass. Connected in said cross beams are supporting hooks 18 between which hooks a filament 19 is stretched in a zig-zag manner. The ends of the filaments are secured to the side beams 12 and 13, respectively, by means of a helically wound portions. As shown in FIG. 2, the cross beams 15 are connected together by a brace 20, which brace consists of two wire pieces 21 and 22 which are each sealed with one end in the quartz beam 15 and the free ends of which are connected together by means of a helically wound piece of wire 23. Said piece of wire 23 with the ends of the pieces of wire 21 and 22 incorporated therein is supported in a cavity 24 which has been formed upon sealing an exhaust tube occurring on the upper wall 3.

In this embodiment the side beams 12 and the side beams 13 are connected together by bridges 25 and 26 which are formed from quartz glass and in the ends of which the sidebeams are sealed. Due to the presence of the bridges 25 and 26 and of the brace 20 a rigid assembly of frames with filaments is obtained which moreover is held in a correct position in the lamp envelope by the incorporation of the central portion of the brace in the cavity 24.

In the stage during the manufacture of the electric incandescent lamp shown in FIG. 3 it appears that the starting material is a lamp envelope which is formed by a tubular part 36 which forms already one assembly with the bottom portion 27 but which is still open at its upper end. The tubes 28 and 29 sealed to the bottom portion 27 are also still open. After inserting the assembly of frames and filaments not shown in this Figure via the open upper end into the lamp envelope, the current supply members are sealed in the tubes 28 and 29 by means of a pinching operation. This is denoted by the numerals 30 and 31. The upper portion 32 of the tube 26 is then softened by means of heating, after which the tube 26 is closed by means of a rotating shaping roller 33 but for a small aperture 34, which is shown in broken lines. An exhaust tube 35 is then sealed to the edge of said aperture 34 after which the lamp envelope is evacuated, rinsed and filled with a suitable filling gas. The exhaust tube is finally sealed, the central portion of the brace which couples the two frames being incorporated in the cavity which remains upon sealing.

What is claimed is:

1. An electric lamp which comprises a glass lamp envelope having a dish-shaped bottom portion and a cavity at the opposite end thereof, said cavity being the interior of a fuse tip of a sealed exhaust tube, two generally planar filaments disposed in generally parallel relationship in said envelope, a frame carrying each filament comprising two side beams and two cross beams disposed in generally parallelogram relationship, first and second supply member extending through and sealed in said bottom portion, said first member being connected to one of said side beams and said second member being connected to the other of said side beams, means for holding said frames relative to the upper wall of the lamp envelope, said means for holding comprising a brace which includes two pieces of wire, one end of each wire being secured to one of said cross beams proximate to said upper wall, the other end of each wire being coupled together and engaging said cavity, and further including quartz bridge-shaped members extending intermediate said side beams proximate to said cross beams that are proximate to said bottom portion.

2. An electric incandescent lamp as claimed in claim 1 wherein said side beams are sealed in said quartz bridge-shaped members.

* * * * *